US005674001A

United States Patent [19]

Weigert

[11] Patent Number: 5,674,001

[45] Date of Patent: Oct. 7, 1997

[54] ASYMMETRICAL LAMP

[75] Inventor: Dedo Weigert, München, Germany

[73] Assignee: Dedo Weigert Film GmbH, Munich, Germany

[21] Appl. No.: 422,882

[22] Filed: Apr. 17, 1995

[30] Foreign Application Priority Data

Apr. 15, 1994 [DE] Germany ..... 44 13 111.9

[51] Int. Cl.[6] ..... F21V 7/02

[52] U.S. Cl. ..... 362/308; 362/282; 362/287; 362/331

[58] Field of Search ..... 359/726, 727; 362/277, 280–283, 285, 287, 308, 331, 61, 66

[56] References Cited

U.S. PATENT DOCUMENTS

| | | | |
|---|---|---|---|
| Re. 14,102 | 4/1916 | Churchill | 362/280 |
| 933,614 | 9/1909 | Betts | 362/282 |
| 1,648,198 | 11/1927 | Ryan | 362/287 |
| 1,654,391 | 12/1927 | Thornton | 362/308 |
| 3,124,309 | 3/1964 | Cantoni et al. | 362/282 |
| 5,113,330 | 5/1992 | Makita | 362/61 |
| 5,158,350 | 10/1992 | Sato | 362/61 |
| 5,258,686 | 11/1993 | Segoshi et al. | 362/61 |
| 5,453,902 | 9/1995 | Watanabe et al. | 362/61 |

FOREIGN PATENT DOCUMENTS

| | | | |
|---|---|---|---|
| 643578 | 9/1928 | France | 362/287 |
| 359752 | 10/1931 | United Kingdom | 362/282 |

OTHER PUBLICATIONS

DEDOLIGHT, Jul. 1989, 8 pages.

*Primary Examiner*—Alan Cariaso
*Attorney, Agent, or Firm*—Griffin, Butler Whisenhunt & Kurtossy

[57] ABSTRACT

An asymmetrical lamp has a main lens (2), a reflector (3) and at least one light source arranged between the reflector (3) and the main lens (2). In order to achieve a uniform illumination of all areas of an object, even when the lamp is not positioned on an axis extending 90° to the object, the light source (1) and the reflector (3) are offset from an optical axis (6) of the main lens (2). The main axes (4, 5) of the light source (1) and the reflector (3) are, further, inclined to the optical axis (6) of the main lens (2). Preferably, the offset of the light source (1) and the reflector (3) relative to the optical axis (6) of the main lens (2), and the inclination of the main axes (4, 5) of the light source (1) and the reflector (3) to the optical axis (6) of the main lens (2), is adjustable so that the lamp can be optimally adjusted.

10 Claims, 7 Drawing Sheets

ASYMMETRICAL LAMP

BACKGROUND OF THE INVENTION

This invention concerns lamps of a type having a main lens, a reflector, and at least one light source arranged between the reflector and the main lens.

Such a lamp is disclosed in a July 1987 published prospectus entitled "DEDOLIGHT" of Dedo Weigert Film GmbH.

If a flat object is illuminated by a lamp which is not positioned directly on an axis extending perpendicular to, or at 90° to, the object, a distance from the light source to one end of the object is greater than that to the other end of the object.

Because the light intensity of conventional light sources, at increasing distances, is reduced by a factor of four, a non-uniform illumination of the flat object results therefrom.

For example, illumination of a painting 16 hung on a wall 14 in a museum is shown in FIG. 7. In order to illuminate the painting 16, a lamp 10 attached to a ceiling 12 is used. The lamp 10 is arranged at such an angle to the painting 16 that observers of the painting 16 are positioned outside of a light cone 18 of the lamp, thus, they do not throw a shadow on the painting 16. The observers should not only be afforded a free line-of-sight to the painting 16 but should also not see bothersome reflections from the surface of the painting 16.

With such an arrangement, the lamp 10 can, for example, be spaced twice as far from a lower edge of the painting 16 as from its upper edge. In this case, the lower edge receives only 25% of the light intensity received by the upper edge; that is, the light intensity at the upper picture frame is four times as great as it is at the lower picture frame.

In the above described "DEDOLIGHT" lamp a particular optical system produces a uniform light-distribution curve as is shown in FIG. 9. With this lamp a desired illumination of a painting is possible. With appropriate predetermined elements, such as flaps or gates, illumination can be partitioned, or shaded, so that the surroundings of the painting do not receive scattered light. With such a lamp, a uniform light intensity in a horizontal direction can be achieved when the painting 16 and the lamp 10 are arranged as shown in FIG. 7. In a vertical direction, however, the light intensity decreases because of the different distances of the lamp from the upper and lower edges of the painting.

A lamp would be suitable for achieving a uniform light intensity in a vertical direction, in an ideal case, if it had a light-distribution curve with a parabolic shape, which falls steeply from its highest point to zero. The highest point corresponds to light intensity of light beams directed toward the lower painting edge. Such a light-distribution curve is shown in FIG. 10.

A substantially correct illumination can also be achieved with a lamp that has a bell-shaped light-distribution curve, as is shown in FIG. 8, such that a point of the highest light intensity lies on the lower edge of the painting. The remainder of light radiation which falls below the painting, is, in this case, partitioned, or shaded. The resulting light-distribution curve is shown in FIG. 11. This means that necessary energy, in a best case, can only be half used and, nevertheless, an ideal illumination can still not be achieved because the bell-shaped light-distribution curve does not have the required parabolic shape.

It is an object of this invention to provide a lamp with structurally uncomplicated parts which makes possible an optimal illumination of an object, even when the lamp is not directly on an axis extending at an angle of 90° to the object.

SUMMARY OF THE INVENTION

According to principles of this invention, in a lamp of the type described in the introductory paragraph above, a light source and a reflector are arranged to be offset from an optical axis of a main lens and main axes of the light source and the reflector are inclined relative to the optical axis of the main lens.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

Figure 1:
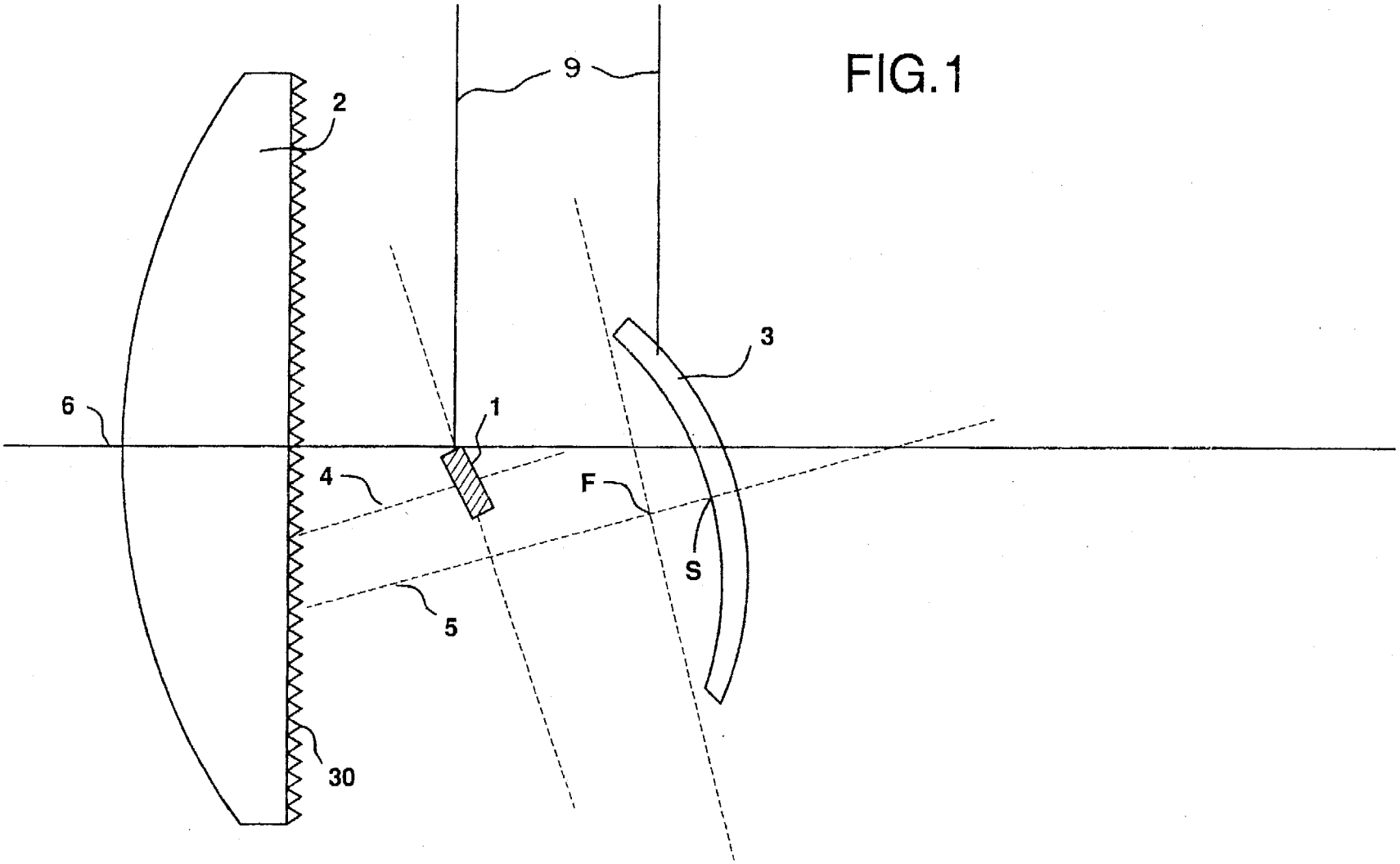
FIG. 1 is a schematic cross-sectional view of a first embodiment of an asymmetrical lamp of this invention.
Figure 2:
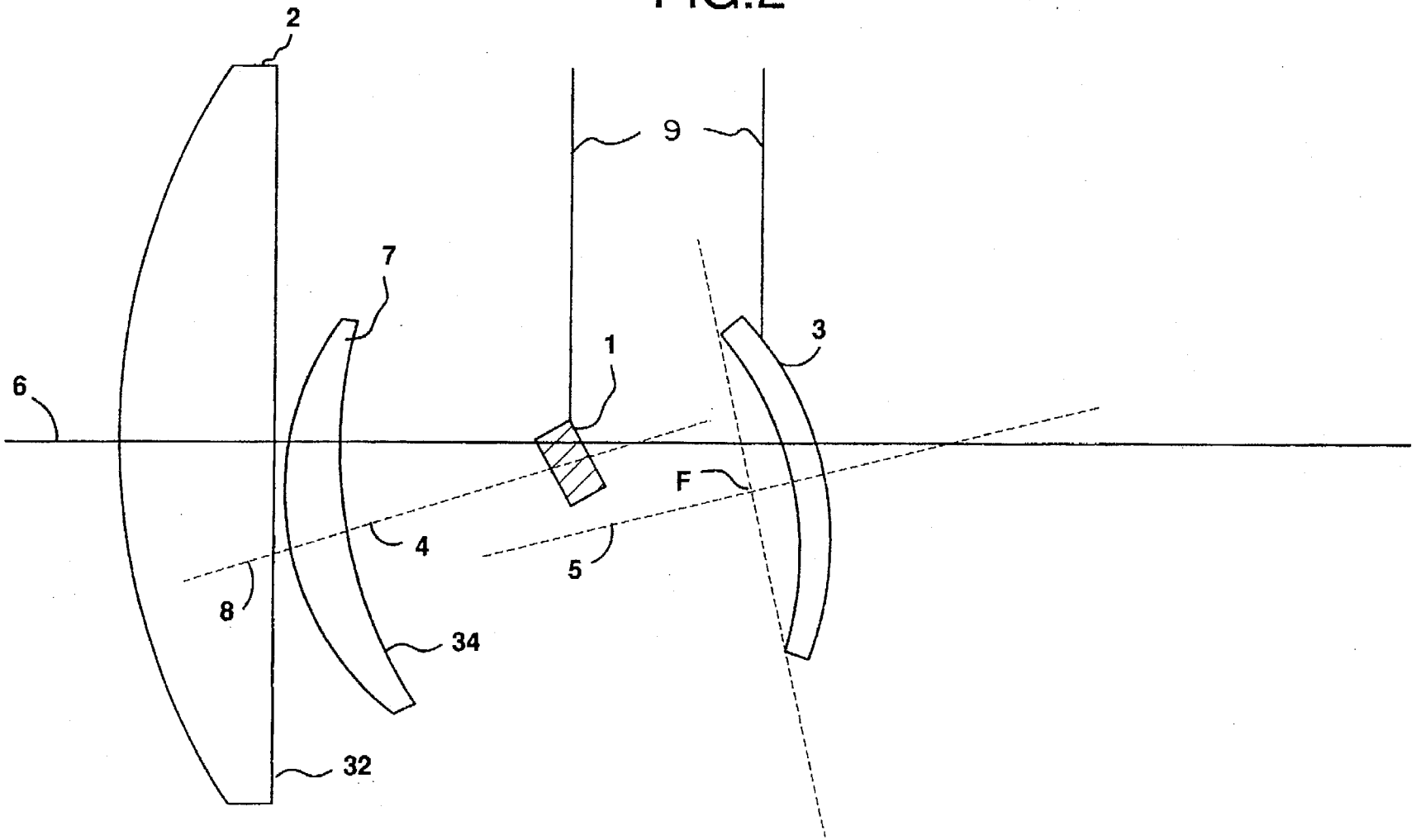
FIG. 2 is a schematic cross-sectional view of a second embodiment of an asymmetrical lamp of this invention which is similar to the embodiment of FIG. 1.
Figure 7:
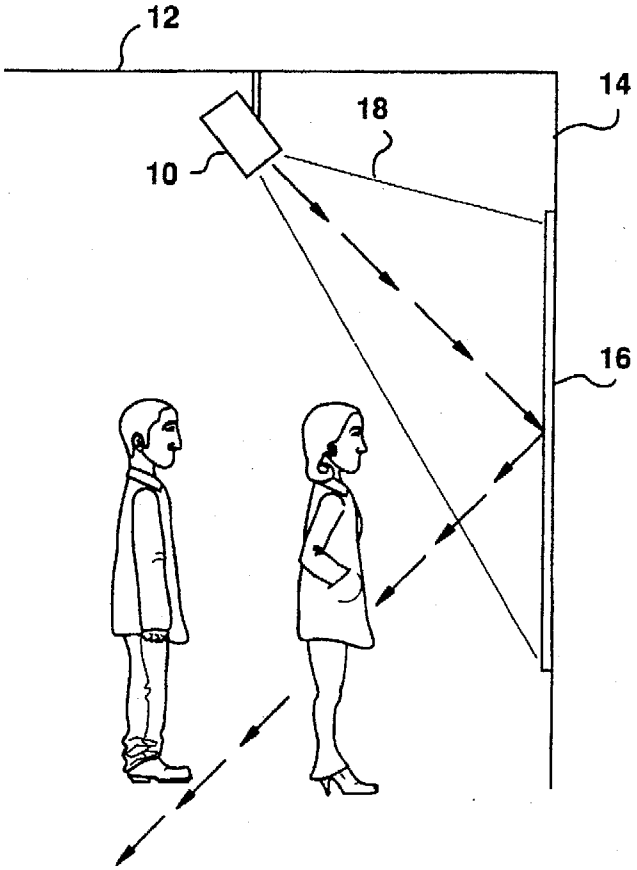
Figure 6A:
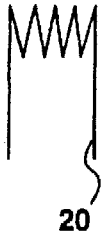
Figure 6B:
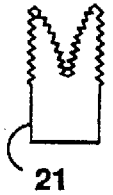
Figure 6C:
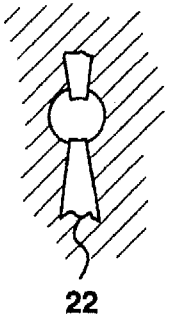
Figure 6D:
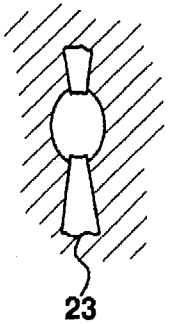
Figure 8:
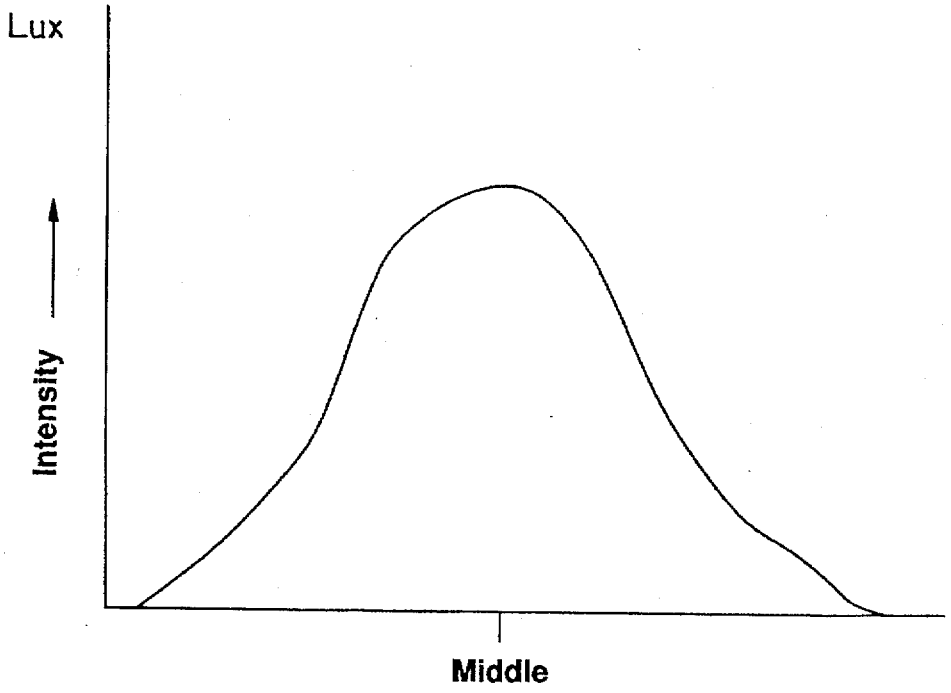
Figure 9:
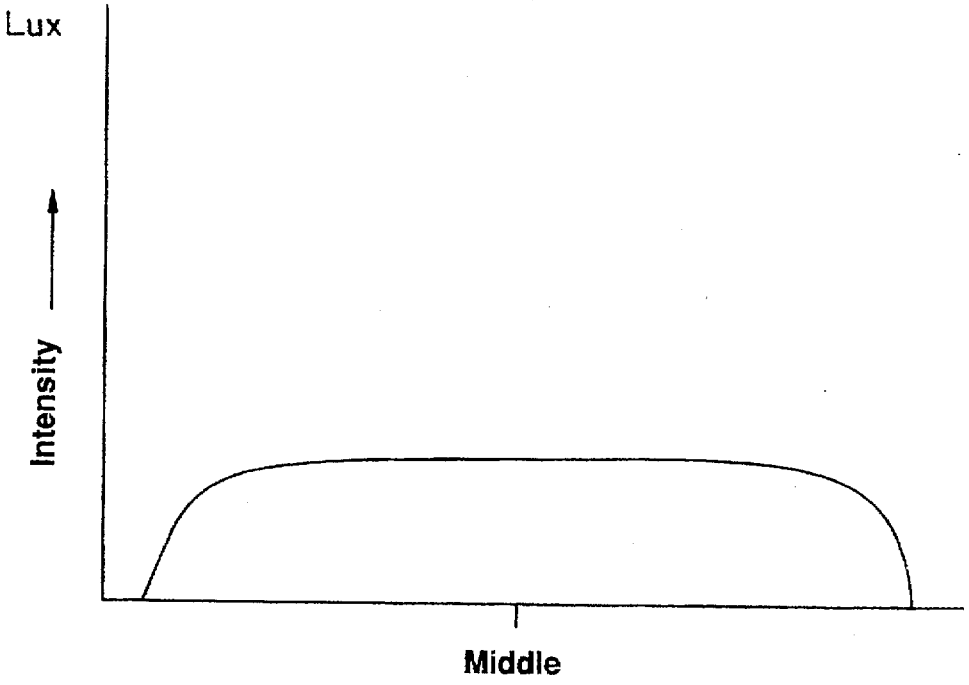
Figure 10:
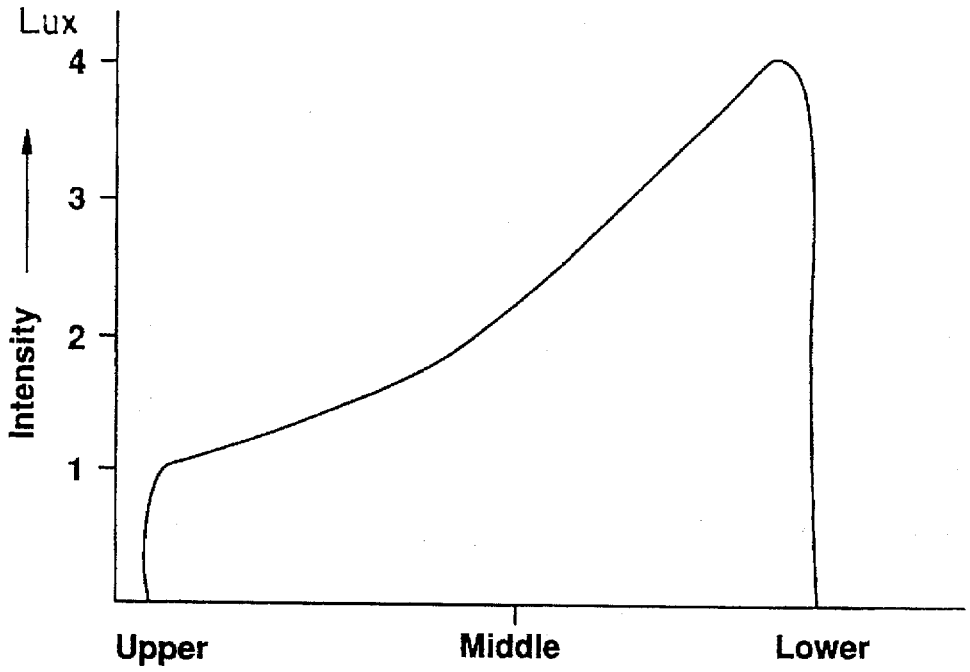
Figure 11:
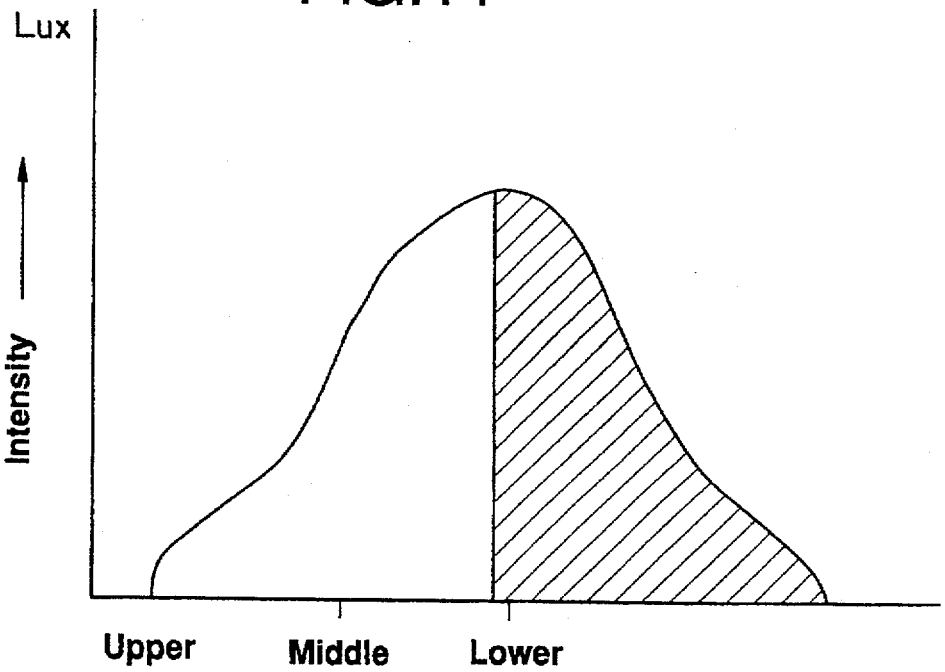
Figure 12:
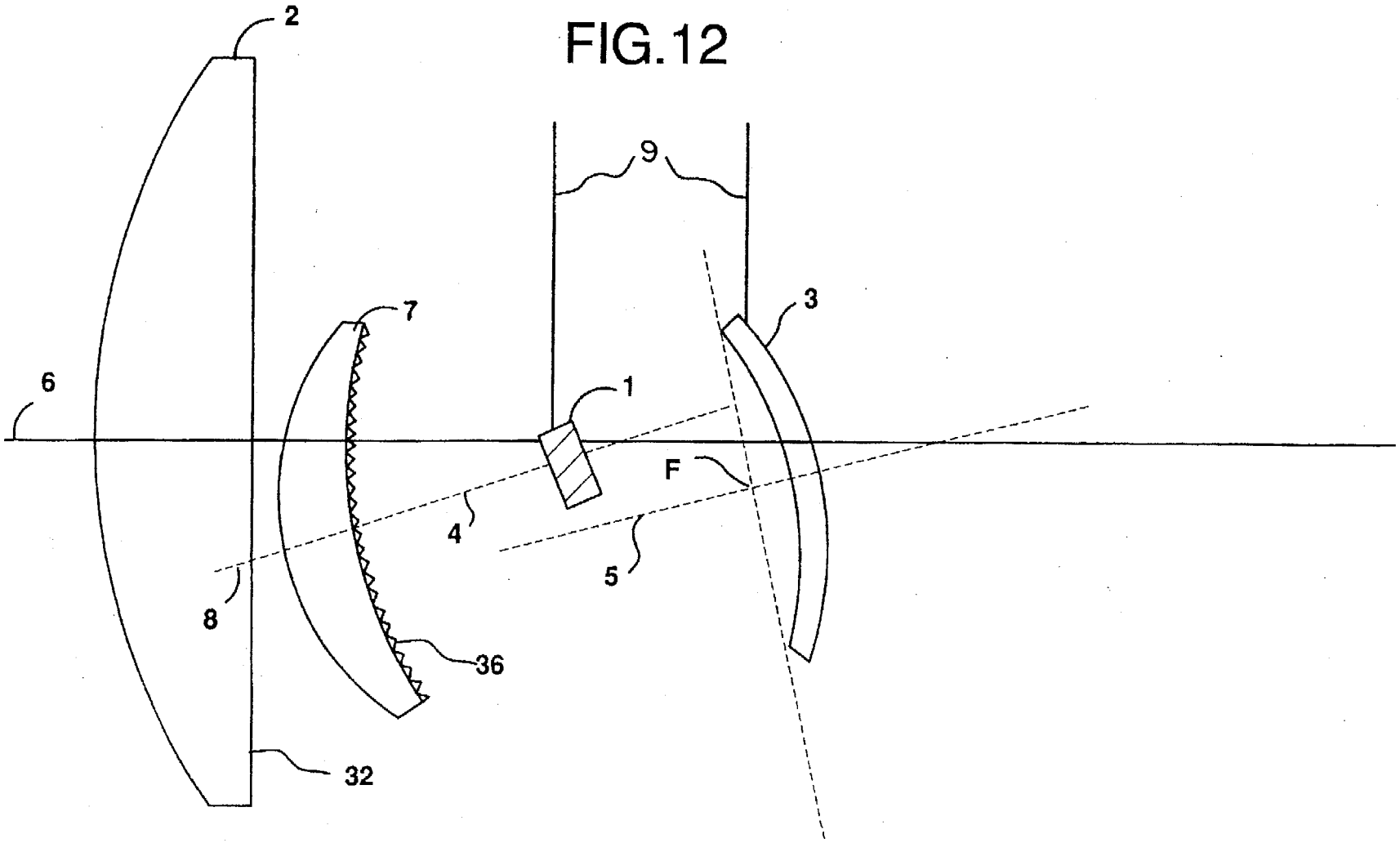

Each of FIGS. 6A, B, C and D discloses a possible light source for the lamp of FIG. 1;

FIG. 7 is a schematic side view of illumination of a painting in a museum with observers standing in front of the painting;

FIG. 8 is a diagram of a bell-shaped light-distribution curve of a known lamp;

FIG. 9 is a diagram of a light intensity distribution curve of a known "DEDOLIGHT" lamp;

FIG. 10 is a diagram of an ideal light-distribution curve for illuminating a flat object from an angle;

FIG. 11 is a diagram of a light-distribution curve of a partitioned, known, lamp with a bell-shaped light-distribution curve; and FIG. 12 is a schematic cross-sectional view of a third embodiment of an asymmetrical lamp of this invention which is similar to the embodiment of FIG. 2.

DESCRIPTION OF THE PREFERRED EMBODIMENT

The lamp shown in FIG. 1 has a main lens 2 which is formed as a plano-convex condenser lens. A reflector 3, formed as a concave mirror, is further provided at a distance from the main lens 2, with the concave mirror's surface facing the plano-surface of the main lens 2. The reflector 3 is offset, or displace, from an optical axis 6 of the lens such that a focal point F and an apex S of the reflector are spaced from the optical axis 6. Further, the reflector 3 is inclined to the main lens 2 so that a main axis 5 of the reflector 3 extends at an angle to the optical axis 6 of the main lens.

A light source 1 is arranged between the reflector 3 and the main lens 2. A plurality of possible light sources 1 are represented in FIGS. 6A–6D. The light source is a type of light source with a small diameter, for example, a bulb with a small filament. If a small voltage halogen lamp is used, a flat core filament 20 is useful. For projection lamps, it is beneficial to employ a folded filament 21. Further, discharge lamps with small circularly shaped light sources 22 or elliptical-type light sources 23 are suitable.

The light source 1 is arranged to be displaced from the optical axis 6 of the main lens 2 in the same direction as is the reflector 3. If a filament is used, the middle of the filament is positioned to be offset from, or displaced from, the optical axis 6 of the main lens 2. Further, a main axis 4, that extends perpendicular to, and from the center of, the filament, is inclined, relative to the optical axis 6 of the lens 2, at a similar or identical angle as is the main axis 5 of the reflector 3.

A plurality of adjusting devices 9 are provided in the lamp with which the offset and the inclination of the light source 1 and the reflector 3, relative to the optical axis 6 of the lens 2, can be adjusted as desired for achieving a uniform light intensity distribution in all areas of an illuminated object. The spacing between the light source 1 and the reflector 3, as well as their positions about, and angles to, the optical axis 6 can be adjusted.

In the shown embodiment, the optical axis 6 and the main axes 4, 5 lie in the same plane. Such an embodiment is suitable for a situation where the lamp is positioned centrally above an object to be illuminated.

For an eccentric illumination, however, it may be necessary to place the main axes 4, 5 so that they do not intersect the optical axis 6, but rather so that they extend in a parallel plane to, or skewed to, the optical axis 6.

The lamp shown in FIG. 2 differs from the lamp of FIG. 1 in that between the light source 1 and the main lens 2 a meniscus-shaped additional lens 7 is arranged such that its convex surface is facing the plano surface of the main lens 2. An intersection point of a main axis 8 of the additional lens 7 with the additional lens 7 is also spaced from the optical axis 6 of the main lens 2. Further, the optical axis 8 of the additional lens 7 is similarly inclined to the optical axis 6 as are the main axes 4, 5. The offset and inclination of the additional lens 7 relative to the optical axis 6 of the main lens 2 is also adjustable by means of an adjusting apparatus 9. By means of the arrangement of the additional lens 7 a still more uniform light intensity distribution is achieved.

Figure 3:
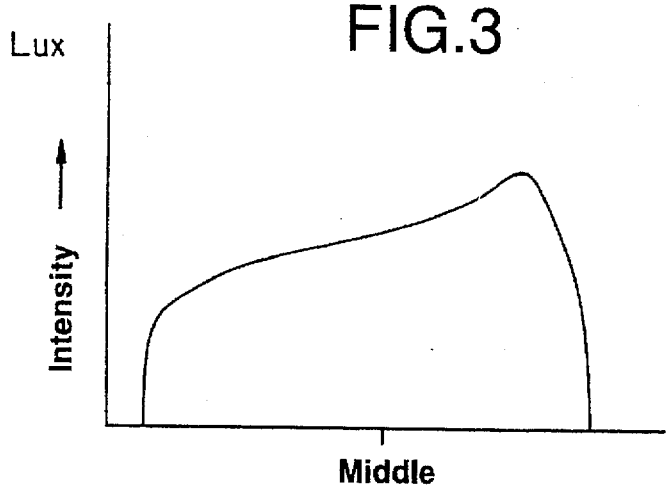
FIG. 3 is a diagram showing a light-distribution curve for illumination of a painting which illustrates the effect on light intensity of offsetting and inclining a light source relative to an optical axis of a lens.

FIG. 3 shows a light-distribution curve of light radiation caused by the light source 1 and the main lens 2 which results from the displacement and inclination of the light source 1 to the optical axis 6 of the main lens 2.

Figure 4:
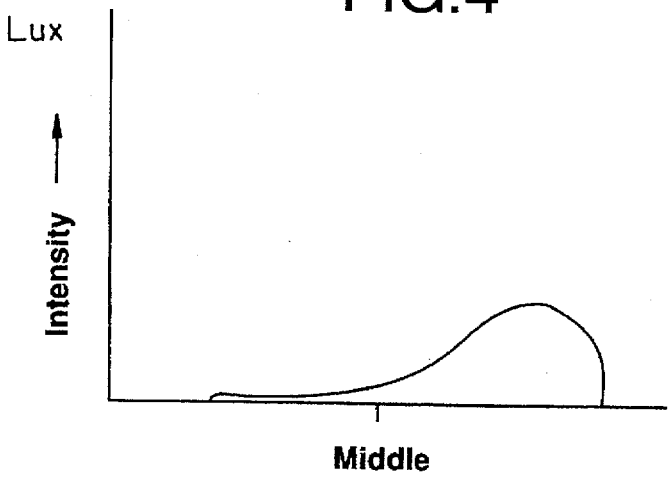
FIG. 4 is a diagram similar to that of FIG. 3 which shows the effect on light intensity of offsetting and inclining a reflector relative to an optical axis of a lens.

FIG. 4 shows a light-distribution curve of a complementing illumination which is achieved by the light source 1, the reflector 3 and the main lens 2.

Figure 5:
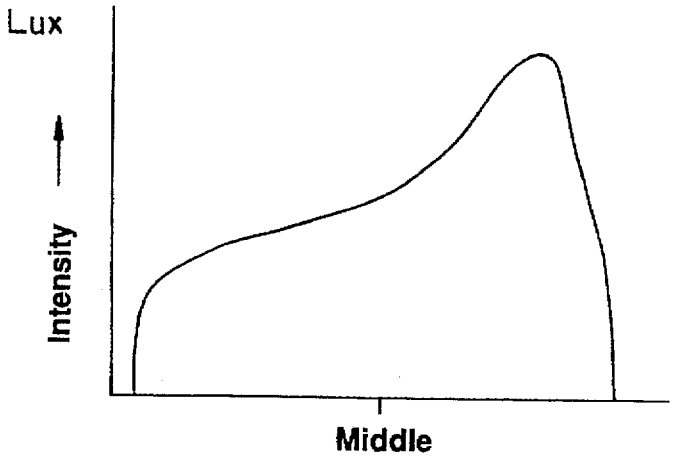
FIG. 5 is a diagram which shows the light-distribution curve of the lamp of FIG. 1.

The addition of the light-distribution curves shown in FIGS. 3 and 4 results in the light-distribution curve in FIG. 5.

It can be recognized that the light-distribution curve shown in FIG. 5 substantially corresponds to an ideal light-distribution curve shown in FIG. 10. Appropriate choice of the displacement, or offset, and the inclination of the light source 1, the reflector 3 and possibly the additional lens 7, allows attainment of an almost ideal light-distribution curve so that it is possible, with a lamp according to this invention, to illuminate all areas of an object with uniform light intensity.

With the inventive arrangement of this lamp it is possible to illuminate all areas of an object with uniform light intensity when the lamp is inclined relative to the illuminated object. The offset and the inclination of the light source and the reflector relative to the optical axis of the main lens depends upon the inclination of the optical axis of the main lens relative to the object. The light-distribution curve of the lamp according to this invention allows a full exploitation of light energy since practically no light appears beyond the object to be illuminated. It is thereby important that the radiated light has the shape of an asymmetrical light cone beyond which no scattered light is created.

Use of a lamp of this invention is not limited to a vertical displacement. The displacement can, according to need, also be horizontal or diagonally upward or downward. In other words, the asymmetry can be arranged to move circularly about the optical axis of the main lens. This allows an eccentric mounting of the lamp relative to the horizontal and vertical axes of an object to be illuminated.

The lamp of this invention is particularly suited for illuminating paintings in museums. It can, however, also be employed for all types of illuminating in which a uniform light distribution on an object is necessary and in which the lamp cannot be mounted at a middle axis perpendicular to an object.

There exists trick tables on which cameras are mounted above an object, directed downwardly. In this case, in the past, two lamps have normally been applied to achieve a uniform illumination.

By use of the lamp of this invention, only a single lamp which is arranged outside of an axis perpendicular to a picture middle is necessary. Basically, in this manner, every flat surface object can be uniformly illuminated from a corresponding angle. A statue can also be illuminated by a lamp of this invention when the lamp is directed upwardly at an angle. The head of the statue then receives the same light intensity as the feet of the statue.

With a central mounting of the lamp relative to a vertical and a horizontal axes of an object it is useful to have the main axis of the light source and the reflector, as well as the optical axis of the main lens, lying in a single plane.

If a lamp of this invention has apparatus which allow adjustment of offset of the light source and the reflector from the optical axis of the main lens, and of inclination of the main axes of the light source and the reflector relative to the optical axis of the main lens, the lamp of this invention can be quickly and uncomplicatedly adapted to illuminate a particular object. The lamp is arranged at a particular angle to a painting. Finally, the offset and inclination are adjusted so that all areas of the illuminated object are illuminated with the same light intensity.

Preferably, a surface of the main lens is cut and etched 32 or provided with a grain structure 30. The crystal structure of a raw cut and etched lens, as well as a grain of a lens surface, serves as a plurality of micro lenses which scatter light beams within the light cone without creating bothersome scattered light or reducing light transmission.

A particularly good adaptation to the ideal curve is possible if an additional lens is arranged between the light source and the main lens to be relatively offset from the optical axis of the main lens, with the main axis of the additional lens being inclined to the optical axis of the main lens. The additional lens can be a plano-convex or a meniscus-shaped condenser lens. A surface of the additional lens can also be cut and etched 34 or provided with a grain, or frosted, structure 36.

While the invention has been particularly shown and described with reference to a preferred embodiment, it will be understood by those of ordinary skill in the art that various changes in form and detail may be made therein without departing from the spirit and scope of the invention.

The embodiments of the invention in which an exclusive property or privilege are claimed are defined as follows:

1. A lamp comprising:

a main lens having a main-lens optical axis;

a reflector having reflector main axis, said reflector being arranged to be offset from the main-lens optical axis and said reflector main axis being inclined relative to the main-lens optical axis; and at least one light source arranged between the reflector and the main lens, having a light-source main axis arranged to be inclined relative to the optical axis of the main lens; wherein a center of the light source is arranged offset from the main-lens optical axis and offset from the reflector main axis wherein is further included an adjusting means for adjusting:

the offset of the light source relative to the main-lens optical axis;

the offset of the reflector relative to the main-lens optical axis;

the inclination of the light-source main axis relative to the main-lens optical axis; and the inclination of the reflector main axis relative to the main-lens optical axis.

2. A lamp as in claim 1 wherein the light source main axis, the reflector main axis, and the main-lens optical axis lie substantially in one plane.

3. A lamp as in claim 1 wherein a surface of the main lens is cut and etched.

4. A lamp as in claim 1 wherein a surface of the main lens is provided with a grain structure.

5. A lamp comprising:

a main lens having a main-lens optical axis;

a reflector having reflector main axis, said reflector being arranged to be offset from the main-lens optical axis and said reflector main axis being inclined relative to the main-lens optical axis; and at least one light source arranged between the reflector and the main lens, having a light-source main axis arranged to be inclined relative to the optical axis of the main lens; wherein a center of the light source is arranged offset from the main-lens optical axis and offset from the reflector main axis; and wherein an additional lens is arranged between the light source and the main lens to be offset from the main-lens optical axis whereby an additional-lens main axis of the additional lens is inclined to the main-lens optical axis.

6. A lamp as in claim 5 wherein a surface of the additional lens is cut and etched.

7. A lamp as in claim 5 wherein a surface of the additional lens is provided with a grain structure.

8. A lamp as in claim 5 wherein the light source main axis, the reflector main axis, and the main-lens optical axis lie substantially in one plane.

9. A lamp as in claim 5 wherein a surface of the main lens is cut and etched.

10. A lamp as in claim 5 wherein a surface of the main lens is provided with a grain structure.

* * * * *